US005624371A

United States Patent [19]

Mohn

[11] Patent Number: 5,624,371

[45] Date of Patent: Apr. 29, 1997

[54] SELF-REGULATING CENTRIFUGAL SEPARATOR

[75] Inventor: Frank Mohn, London, Great Britain

[73] Assignee: Framo Developments (UK) Limited, London, Great Britain

[21] Appl. No.: 244,749

[22] PCT Filed: Dec. 11, 1991

[86] PCT No.: PCT/GB92/02310

§ 371 Date: Aug. 15, 1994

§ 102(e) Date: Aug. 15, 1994

[87] PCT Pub. No.: WO93/11877

PCT Pub. Date: Jun. 24, 1993

[30] Foreign Application Priority Data

Dec. 12, 1991 [GB] United Kingdom ..... 9126415

[51] Int. Cl.[6] ..... B04B 5/06; B04B 11/02

[52] U.S. Cl. ..... 494/22; 494/56; 494/901

[58] Field of Search ..... 494/22, 37, 43, 494/56, 67, 76, 77, 80, 901; 366/305

[56] References Cited

U.S. PATENT DOCUMENTS

| | | | |
|---|---|---|---|
| 2,619,280 | 11/1952 | Redlich | 494/22 |
| 3,814,307 | 6/1974 | Hengstebeck | 494/22 |
| 4,010,891 | 3/1977 | Kartinen | 494/901 X |
| 4,362,620 | 12/1982 | High . | |
| 4,842,738 | 6/1989 | Greenspan | 494/56 X |
| 4,857,040 | 8/1989 | Kashihara et al. | 494/56 X |

FOREIGN PATENT DOCUMENTS

| | | |
|---|---|---|
| 0018474 | 11/1980 | European Pat. Off. . |
| 40702 | 8/1886 | Germany . |
| 2336564 | 4/1975 | Germany . |
| 260071 | 10/1926 | United Kingdom . |

*Primary Examiner*—Charles E. Cooley
*Attorney, Agent, or Firm*—Young & Thompson

[57] ABSTRACT

A centrifugal separator comprises a drum (1) rotatable about its axis within which annular walls (10, 20) define discharge chambers (11, 21) at the ends of the drum, from which separated fluids of different specific gravities are discharged by respective scoops (14, 24). Alternatively, annular walls (44, 45 and 47, 49) define both such chambers at one end only of the drum. The dimensions of the annular walls are chosen so that the separator is self-regulating, in that the separated fluids are discharged independently of the proportions of the fluids in the incoming mixture, so that operation of the separator does not have to be controlled in response to sensing of the separation process within the drum.

10 Claims, 2 Drawing Sheets

SELF-REGULATING CENTRIFUGAL SEPARATOR

FIELD OF THE INVENTION

The invention relates to centrifuges, or centrifugal separators, such as are used separating the components of a mixed fluid stream.

BACKGROUND OF THE INVENTION

Centrifugal separators typically comprise a vessel with a cylindrical wall which is rotated about its axis. A mixture of fluids of different specific gravities is introduced and concentric annular layers of the individual fluids are formed, with the fluid of greatest specific gravity forming the outermost layer against the cylindrical wall and with the liquid with the least specific gravity forming the layer nearest the axis. The separation effected in this way within the centrifuge has of course to be maintained during extraction of the liquids from it, in spite of varying proportions of the liquid in the incoming mixtures. Operation of the centrifuge can be controlled by a flow control system dependent on the use of sensing devices to detect the positions of the level of the layers or radial interface between them, as described, for example in U.S. Pat. No. 4,846,780. The level or interface sensing means and related control arrangements represent a considerable complication, making a substantial contribution to the complexity and cost of the equipment.

SUMMARY OF THE INVENTION

The present invention is accordingly concerned with the provision of a centrifuge or centrifugal separator which is self-regulating and thus not dependent for its operation on the sensing of the position within it of an interface between adjacent layers of separated liquids.

The invention accordingly provides a centrifuge for regulating the flow of fluids so as to effect separation of first and second fluids of a first and a second, greater, specific gravity, respectively, from a mixture of the fluids regardless of the proportions of the fluids in the mixture, the centrifuge comprising a drum (1) rotatable about the axis (6) thereof to form an annular layer (9) of the second fluid around an annular layer (7) of the first fluid, and first (10,11,14,15) and second (20,21,24,25) discharge chambers (11,12) defined by respective first and second walls (10,20) providing first and second annular weir edges controlling the respective discharge flows, for respective discharge of the first and second fluids from the respective layers outwardly of the drum, characterised in that a sleeve (26) concentric with the drum axis (6) extends from the second wall towards the first wall to provide a generally axial flow path for the second fluid which reverses direction at the free end of the sleeve, and extends into the second discharge chamber between the second wall and the side wall (2) of the drum (1). Discharge from the centrifuge is effected by scoops operating in scoop chambers formed at the respective axial ends of the centrifuge, and flows of the liquids from the separated layers within the main volume of the centrifuge is controlled by annular plates or baffles forming weirs which are so dimensioned as to substantially prevent flows from a first layer into the scoop chamber receiving flow from the other layer, even when input to the centrifuge consists substantially entirely of the liquid forming the first layer.

Centrifugal separator devices in accordance with the invention can be employed for example to separate oil from water in an oil extraction system. A well stream may contain gas, oil, water and particulate material, for example, sand. After removal of sand and gas, separation of the oil and water has to be effected to obtain a yield of useful oil thus this can be readily effected by means of the centrifuge of the invention, which is not however limited to this use.

BRIEF DESCRIPTION OF THE DRAWINGS

The invention is further described below, by way of example, with reference to the accompanying drawings, in which.

DETAILED DESCRIPTION OF THE INVENTION

Figure 1:
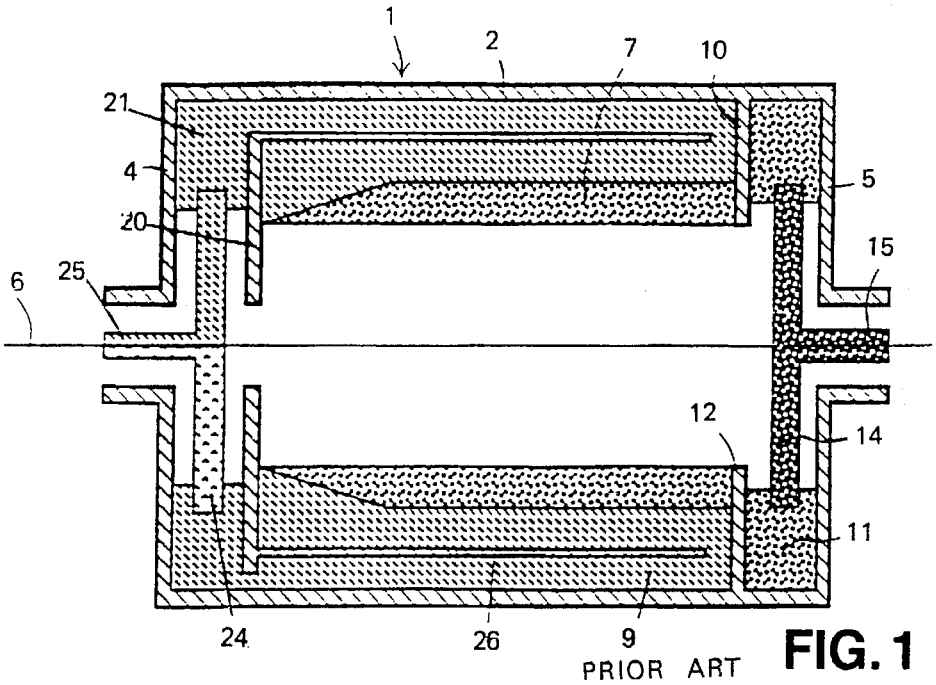
FIG. 1 is a schematic cross-sectional side view of a typical centrifuge.

The centrifuge of FIG. 1 comprises a rotatable housing or drum 1 with a cylindrical outer wall 2 and end walls 4 and 5. The drum 1 is mounted so as to be rotatably driven about its axis 6 by any appropriate drive means (not shown). In the Figure, the axis 6 is shown as extending horizontally but the axis can be vertical or have any other desired orientation. A mixture of oil and water, or of other liquids of different specific gravities, is introduced into the drum by a suitable feeder unit (not shown) and the rotation of the drum causes the mixture to separate into concentric layers because of the different specific gravities of the liquids. Thus, an inner annular layer 7 of oil becomes surrounded by an outer annular layer of water 9 confined externally by the cylindrical wall 2 of the drum.

It is of course necessary to arrange for separate extraction from the oil and the water layers, and at a position spaced from the righthand end wall 5, a transverse annular inner wall 10 extends inwardly from the wall 2 to define with the end wall an oil discharge chamber 11.

Oil enters the chamber 11 from the layer 7 over the inner edge 12 of the annular wall 10 and discharges from the drum 1 by way of an oil scoop 14 within the chamber and an axial discharge pipe 15.

Water is similarly discharged from the lefthand end of the drum 1, from a water discharge chamber 21, by way of a water scoop 24 and an axially directed discharge pipe 25. The water discharge chamber is again defined by an annular transverse wall, wall 20, spaced from the end wall 4, but the annular wall 20, is spaced inwardly from the drum wall, and a separator sleeve 26, extends axially from its outer edge towards the oil discharge chamber to a position spaced from the wall 10. Water consequently flows axially first towards the oil discharge chamber and it then reverses direction to flow axially into the water discharge chamber.

For a total fluid flow through the centrifuge of 25,000 bbl/d (165 m/h), a maximum water flow of 12,500 bbl/d (83 m/h), and a maximum oil flow of 18,000 bbl/d (119 m/h), suitable operating characteristics and dimensions of the centrifuge can be determined by evaluation of the flow paths, as follows:

| | |
|---|---|
| Density of crude oil: | p(o) = 870 kg/m |
| Density of water: | p( ) = 1000 kg/m |
| Centrifuge rotation speed: | n = 3600 rpm, = 377 rad/sec |
| Diameter of the free surface of | 457 mm |
| Inside diameter of the cylindrical wall 2: water in the water discharge chamber 21: | 384.5 mm |
| Outer diameter of the separator sleeve 26: | 439 mm |
| Inner diameter of the separator sleeve 26: | 433 mm |
| Diameter of water/oil interface: | 407 mm |
| Diameter of the free surface of the oil layer 7: | 381 mm |
| Diameter of edge of wall 20 at entry into the water discharge chamber 21: | 448 mm |

The centrifuge of FIG. 1 can thus be designed to operate satisfactorily, that is, without discharge of any substantial amount of water through pipe 15, or of oil through pipe 25, provided the ratio of oil to water in the incoming mixture does not vary very substantially. To enable the centifuge to operate with incoming mixtures which vary considerably in the ratio of the components, the centrifuge is modified and dimensioned as appears from FIGS. 2 and 3.

Figure 2:
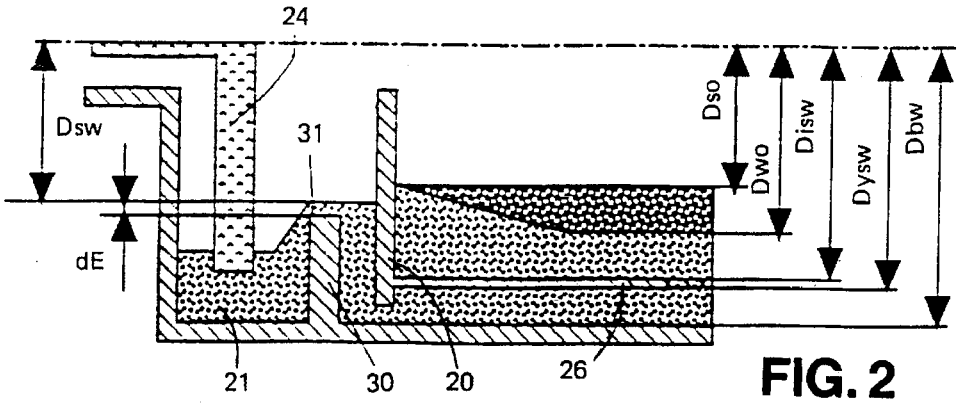
FIG. 2 is a partial view, on a slightly larger scale, corresponding to the lower left hand part of FIG. 1 but showing a centrifuge and modified in accordance with the present invention, and indicating dimensions referred to in the description.

As shown in FIG. 2 an additional weir or annular wall 30 extends inwardly from the cylindrical wall 2 between the water scoop 24 and the wall 20, so that its inner edge 31 controls liquid entry into the water discharge chamber.

From the dimensions given above the liquid level, Dsw in FIG. 2, (384.5 mm) in the water discharge chamber is 1.75 mm below the level of the oil layer in the main column of the drum, Dso in FIG. 3, (381 mm). If the wall 30 has an internal diameter of 389.5 mm, water at the maximum water flow of 12,500 bbl/d, will pass over the wall into the water discharge chamber 21.

Such an arrangement will be self-regulating provided that the water scoop 24 is able to take out the water that comes into the water discharge chamber with a flow characteristic providing capacity which increases proportionally to the depth of submergence of the scoop and shows no malfunction at different flow rates due for example to gas entering the scoop.

Figure 3:
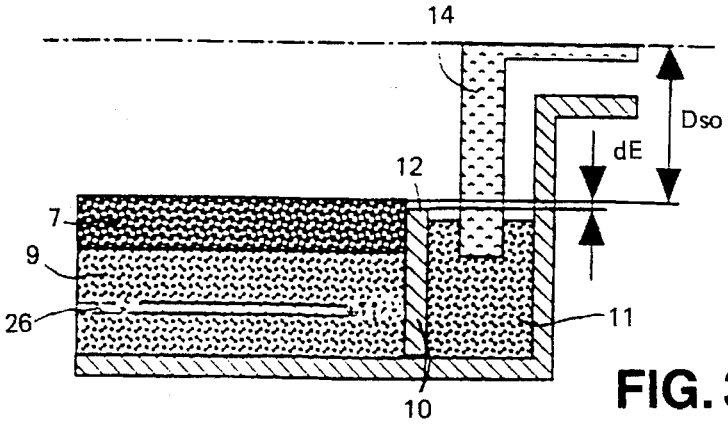
FIG. 3 resembles FIG. 2 but corresponds to the lower right hand side of FIG. 1.

The oil discharge arrangement will be self-regulating with the distance dE shown in FIG. 3 equal to 3.25 mm. With the maximum oil inflow (18,000 bbl/d), oil will flow over the edge 12 and into the oil discharge chamber 11.

Suppose first that the centrifuge is operated normally with a crude oil mixture of oil and water which suddenly changes so as to contain substantially no water and to consist substantially only of oil.

The flow of water over the edge 31 of the wall 30 into the water discharge chamber will be reduced until the water level Dsw in the chamber drops to the edge diameter of the wall 30 (389.5 mm). Provided the oil flow is maintained at 18,000 bbl/d the oil level inside the centrifuge will remain constant as this is determined by the diameter of the edge of the wall 10.

As water drains from the centrifuge the water/oil interface increases in diameter. The location of the interface can be found from:

$$p(w)*(Dbw-Dsw)=p(o)*(Dwo-Ds)+p(w)*(Dbw-Dwo)$$

In this equation, and as shown in FIG. 2:

Dsw is the diameter of the free surface of water in the water discharge chamber 21, Dbw is the inside diameter of the cylindrical wall 2, Dwo is the diameter of the water/oil interface, and Ds is the free surface diameter of the oil layer 7

With the dimensions given above the result is:

$$Dwo=442 \text{ mm}$$

The surface of the oil (Ds) is at 381 mm, so that the thickness of the oil layer 7 increases from 13 mm to 30.5 mm and the oil layer enters the return layer of the water. Accordingly to prevent this, the thickness of the wall of the liquid separator sleeve 26 is increased, or the relative thicknesses of the oil and water layers is altered by appropriate selection of Dsw and Dso.

Suppose now that the centrifuge, after operating normally with a mixture of oil and water, suddenly experiences an inflow consisting essentially of water and containing substantially no oil. The flow of oil over the edge 12 of the wall 10 into the oil discharge chamber 11 is reduced to zero and the diameter of the water/oil interface will decrease until a balance is reached with the surface of the water in the water discharge chamber inlet and the edge 12.

Provided the water flow is maintained at 12,500 bl/d, the water level inside the water discharge chamber 21 will remain constant at 384.5 mm. The edge 12 into the oil discharge chamber 11 being at 387.5 mm, is below the water surface diameter. This results firstly in a drainage of oil from the separator, after which water would flow over the edge 12 into the oil discharge chamber.

In accordance with the invention the thickness of the layers is altered to create a larger height difference between the water surface level in the water discharge chamber and the oil surface level inside the main volume of the centrifuge.

By arranging for the thickness of the oil and water layers to increase from 13 to 25 mm, the diameter of the centrifuge being held constant, the following dimensions are obtained:

| | |
|---|---|
| Surface diameter (Dso) of the oil layer 7 | 339 mm |
| Diameter (Dwo) of the water/oil interface | 407 mm |
| Outer diameter of separator sleeve 26: | Dyso = 439 mm |
| Interior diameter (Dbs) of the drum 2: | 457 mm |
| Diameter (Dsw) of the surface of the water entering the discharge chamber 21 | 349 mm |

The required thickness of the water flowing over the edge 31 into the water discharge chamber is still 2.5 mm, giving an edge diameter of 354 mm.

The thickness of the oil flowing into the oil discharge chamber 11 has to be adjusted from 3.25 mm to 3.5 mm, because the diameter of the surface is reduced and the pressure caused by centrifugal force is lower.

The diameter of the edge 12 at the discharge chamber 11 is now 346 mm. With an input of 100% water, the level inside the centrifuge will be lower than the oil edge diameter and there is no longer any risk that water will enter the oil discharge chamber 11. With an input of 100% oil, the water/oil interface diameter (Dwo) will increase to 441.5 mm, allowing a slight oil entry into the water discharge chamber 21 so the diameter of the edge 31 is increased about 1 mm and/or the thickness of the separator sleeve 26 is increased, to prevent oil from entering the water discharge chamber.

Figure 4:
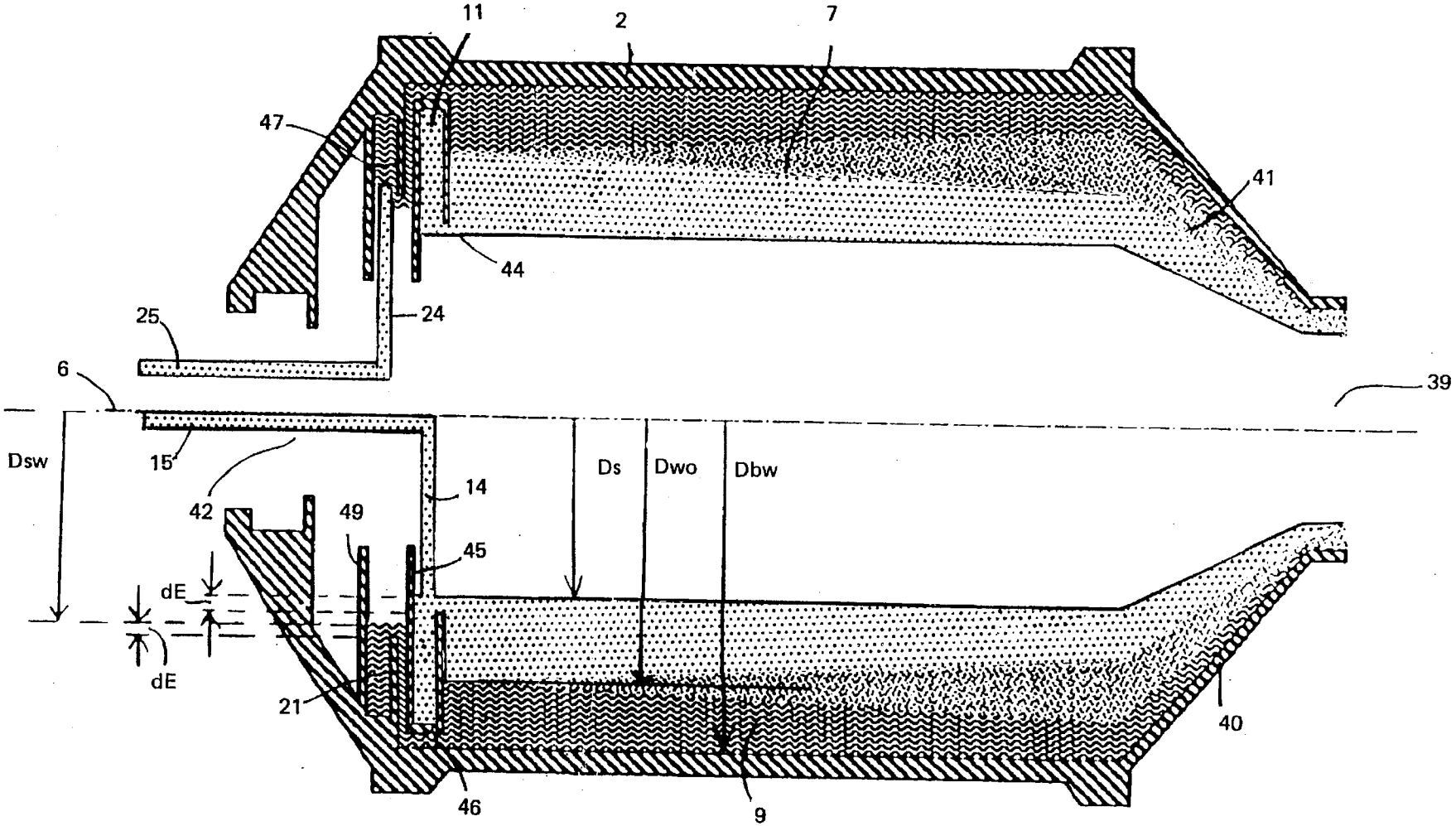
FIG. 4 is a schematic cross-sectional view of a second centrifuge in accordance with the invention.

The apparatus illustrated in FIGS. 1–3 provides for the oil and water discharge pipes 15,25 to be located at opposed ends of the drum 1, but a centrifuge in accordance with the invention can be organised so that both the discharge pipes are at the same end, as shown in FIG. 4, in which the reference numerals employed for certain parts of the centrifuge of FIGS. 1–3 are used to indicate parts with similar functions.

The mixture to be separated is introduced into the drum at an inlet end 39 defined by an axially outwardly convergent frusto conical end wall 40 against which forms the water layer 9 in a thickness which increases in the flow direction towards the cylindrical wall 2 and the outlet end 42 of the centrifuge. The inner layer 7 of oil is similarly formed, with an intermediate layer 41 of the unseparated mixture between it and the layer 9. The thickness of the intermediate layer 41 decreases to zero at the outlet end of the centrifuge, as its components separate out into the oil and water layers.

Adjacent the outlet end 42, the oil discharge chamber 11 is defined by two axially spaced annular walls 44, 45 joined at their outer periphery by a short cylindrical portion 46, spaced from the wall 2. The oil in the layer 7 enters the discharge chamber 11 over the outer edge of the wall 44 and is removed by the oil discharge 14. The water scoop chamber 21 is defined by two further axially spaced annular end walls 47, 49 which extend directly from the cylindrical wall 2. The wall 49 adjacent the outlet end 42 has the same inner diameter as the wall 45 but the diameter of the wall 47 exceeds that of wall 44.

Water from the layer 9 thus enters the water discharge chamber 21 between the wall 2 and the cylindrical portion 46, moving them radially inwardly and over the inner edge of the wall 47, to be extracted by the water scoop 24.

The centrifuge of FIG. 4 thus operates with unidirectional flow of the mixture and of the oil and water layers, without the reversal of axial direction required for the water flow in the centrifuge of FIGS. 1–3. The centrifuge of FIG. 4 is of course dimensioned so as to be self-regulating in the same way as the centrifuge of FIG. 1–3, and the dimensions noted in FIGS. 2 and 3 are indicated in FIG. 4.

The internal diameter of the annular wall may be predetermined as a function of the Reynolds number for the fluid mixture.

Although the invention has been specifically described with reference to centrifuges for separating oil and water, it is to be understood that the invention could be embodied in centrifuges designed to separate other liquids. The invention can be embodied in a variety of ways other than as specifically described and illustrated.

I claim:

1. A centrifuge for regulating flow of fluids so as to effect separation of first and second fluids of a first and a second, greater, specific gravity, respectively, from a mixture of the fluids regardless of the proportions of the fluids in the mixture, the centrifuge comprising:

a drum having a side wall, an axis and means for rotating the drum about the axis and forming an annular layer of the second fluid around an annular layer of the first fluid, and first and second discharge means comprising first and second discharge chambers defined by respective first and second annular walls providing first and second annular weir edges controlling the respective discharge flows, for respective discharge of the first and second fluids from the respective layers outwardly of the drum, said first annular wall extending in a radial direction relative to and toward said axis from said side wall, and said second annular wall being spaced from said side wall and extending in said radial direction, said second annular wall being disposed between said axis and said side wall, the discharge means further comprising respective stationary members for drawing off respective fluids, and a sleeve concentric with the drum axis extending from the second annular wall towards the first annular wall and terminating at a free end spaced from said first annular wall, said sleeve providing a generally axial flow path for the second fluid which reverses direction at the free end and extends into the second discharge chamber between the second annular wall and the side wall of the drum, and a third annular wall extending radially inwardly from the drum side wall within the second discharge chamber to a position radially short of the second weir edge.

2. A centrifuge as claimed in claim 1, wherein the stationary members comprise non-rotating respective scoops for extracting fluids from the first and second discharge chambers and discharging the fluids axially of the drum.

3. A centrifuge as claimed in claim 1, wherein the third annular wall has an internal diameter predetermined as a function of at least one of the relative specific gravities of the separated fluids, the velocity of the separated fluids and the depth of fluid in the drum.

4. A centrifuge as claimed in claim 3, wherein the internal diameter of the third annular wall is predetermined as a function of the Reynolds number for the fluid mixture.

5. A centrifuge as claimed in claim 3, wherein said centrifuge has internal dimensions which are predetermined as a function of flow paths of the fluids.

6. A centrifuge as claimed in claim 3, wherein the stationary members for drawing off fluids each comprise a stationary scoop adapted to draw off fluid at a rate proportional to its depth of submersion in the respective separated fluid.

7. A centrifuge as claimed in claim 1, wherein the two discharge chambers are at opposed ends of the drum.

8. A centrifuge as claimed in claim 1, wherein the stationary members for drawing off fluids comprise a fluid scoop extending into each discharge chamber and connected to axially extending discharge pipes, and wherein the position and dimensions of the scoops are predetermined in accordance with an operating parameter of the centrifuge.

9. A process of separating a mixture of fluids by centrifugal action comprising: supplying the fluid mixture to the axially rotating drum of the centrifuge according to claim 1, and drawing off separated fluid from each discharge chamber at a flow rate dependent upon the internal diameter of the third annular wall so that the process is self-regulating.

10. A process as claimed in claim 9, wherein the fluid mixture comprises a mixture of oil and water.

* * * * *